US005672871A

United States Patent [19]

Jacobs et al.

[11] Patent Number: 5,672,871

[45] Date of Patent: Sep. 30, 1997

[54] CORONA WIRE HANDLING DEVICE

[75] Inventors: Michael E. Jacobs; John W. May, both of Rochester, N.Y.

[73] Assignee: Eastman Kodak Company, Rochester, N.Y.

[21] Appl. No.: 609,073

[22] Filed: Feb. 29, 1996

[51] Int. Cl.[6] ..... H01J 19/04

[52] U.S. Cl. ..... 250/324

[58] Field of Search ..... 250/324, 325, 250/326; 361/230; 355/133

[56] References Cited

U.S. PATENT DOCUMENTS

| | | | |
|---|---|---|---|
| 4,764,675 | 8/1988 | Levy et al. | 250/324 |
| 5,074,484 | 12/1991 | Kray | 242/129.8 |
| 5,140,367 | 8/1992 | Oleksinski et al. | 355/133 |
| 5,181,069 | 1/1993 | Olekinski et al. | 355/133 |
| 5,424,540 | 6/1995 | Garcia et al. | 250/326 |
| 5,449,906 | 9/1995 | Osbourne | 250/324 |

*Primary Examiner*—Bruce Anderson
*Attorney, Agent, or Firm*—Lawrence P. Kessler

[57] ABSTRACT

A device for handling corona charger wires in order to facilitate the placement of wires within the housing of the corona charger. The corona wire handling device includes a substantially rectangular frame, the frame having opposed long side members and opposed short side members. The long side members of the rectangular frame are readily separable from the short side members thereof. A mechanism, associated with the rectangular frame, is provided for supporting an intermediate portion of at least one corona wire on the frame. Further, a mechanism is provided for controlling tension on the corona wire induced by the corona wire intermediate support mechanism. Accordingly, when the rectangular frame is associated with the corona charger for placement of a corona wire operatively therein and the tension control mechanism is activated, tension increase in the corona wire induced by insertion of the corona wire in the corona charger is controlled to balance wire tension in order to prevent corona wire damage or breakage. Thereafter, the long side members of the rectangular frame are separated from the short side members to enable removal of excess portions of the rectangular frame and the wire supporting mechanism.

20 Claims, 3 Drawing Sheets

CORONA WIRE HANDLING DEVICE

BACKGROUND OF THE INVENTION

The present invention relates in general to corona chargers, and more particularly to a device for handling corona wires to facilitate insertion of the wires into a corona charger housing shell.

In typical commercial electrostatographic reproduction apparatus (copier/duplicators, printers, or the like), a latent image charge pattern is formed on a uniformly charged charge-retentive or photoconductive member having dielectric characteristics (hereinafter referred to as the dielectric member). Pigmented marking particles are attracted to the latent image charge pattern to develop such image on the dielectric member. A receiver member is then brought into contact with the dielectric member, and an electric field applied to transfer the marking particle developed image to the receiver member from the dielectric member. After transfer, the receiver member bearing the transferred image is transported away from the dielectric member, and the image is fixed to the receiver member by heat and/or pressure to form a permanent reproduction thereon.

The electrostatic charging currents required for various electrographic reproduction operations are commonly provided by corona charger devices. For example, corona chargers may be used to deposit uniform charge on the dielectric member prior to light exposure, to implement transfer of a developed image from the dielectric member to a receiver member, or to neutralize charge on the dielectric member subsequent to developed image transfer to facilitate release of the receiver member or residual marking particles from the dielectric member. Corona chargers typically include at least one very thin corona wire located within a housing shell. The corona wire, tightly suspended between insulating end blocks supported in the housing shell, is electrically coupled to a high voltage for producing the ion generating condition at the corona wire to generate ions or charging current to charge a surface (such as the dielectric member surface) brought into close proximity with the corona wire. The tension in the corona wire should be maintained within a particular preselected range to prevent the corona wire from being easily broken (tension too high), or vibrating excessively (tension too low) which will materially effect the ability of the wire to provide for the desired uniform charging of the selected surface.

It should be well appreciated that the high voltage on the corona wire creates a corrosive environment which adversely effects the wire. That is, the highly energized atmosphere surrounding the wire is conducive to the promotion of coating and/or pitting of the wire. The coating of the corona wire is irregular and comprises non-uniform deposits of solids produced by chemical degradation of contamination species in the air surrounding the corona wire. Over time, such action on the corona wire will cause the wire, which by its very nature and geometry is extremely fragile, to no longer be effective in producing the desired uniform charging of the surface intended to have a charge applied thereto. The fragile corona wire may become weakened by the corrosive action and eventually will break. In either eventuality, the corona wire has to be periodically replaced. However, due to the mounting of the corona wire under tension, it has been difficult to readily effect wire replacement.

One type of corona charger device which attempts to facilitate corona wire replacement is shown in U.S. Pat. No. 4,764,675 (issued Aug. 16, 1988, in the name of Levy et al). In the corona charger device of this patent, a pivot member is mounted on an end block of the device. The pivot member is movable to a first position where the corona wire can be connected to the pivot member while untensioned, and to a second position where the wire is held under a selected tension. However, due to the space constraints with the particular arrangement of this charging device, it is still extremely difficult to attach the corona wire to the pivot member. Thus, because of the fragile nature of the wire, the attempted attachment of the wire to the pivot member may still often cause the wire to break as it is being replaced.

Another corona charger device which attempts to facilitate corona wire replacement is shown in U.S. Pat. No. 5,424,540 (issued Jun. 13, 1995, in the name of Garcia et al). The corona charger device comprises at least one corona wire, and a housing. A mechanism, located in the housing, anchors one end of the corona wire and electrically couples an electrical potential source to the corona wire. A tensioning mechanism is removably receivable in the housing in spaced relation to the anchoring mechanism. The tensioning mechanism has an anchor for securing the opposite end of the corona wire thereto, and an arm adapted to engage the housing along a line which forms a pivot axis for the tensioning mechanism. After the corona wire is easily and readily anchored to the tensioning mechanism remotely from the housing, the tensioning mechanism can be received in the housing and pivoted about the pivot axis to a position to apply a preselected tensioning to the corona wire. While this mechanism provides a substantial improvement over previous .corona wire tensioning mechanisms, it still requires careful handling of the delicate corona wires to successfully accomplish necessary wire replacement.

SUMMARY OF THE INVENTION

In view of the foregoing discussion, this invention is directed to a device for handling corona charger wires in order to facilitate the placement of wires within the housing of the corona charger. The corona wire handling device includes a substantially rectangular frame, the frame having opposed long side members and opposed short side members. The long side members of the rectangular frame are readily separable from the short side members thereof. A mechanism, associated with the rectangular frame, is provided for supporting an intermediate portion of at least one corona wire on the frame. Further, a mechanism is provided for controlling tension on the corona wire induced by the corona wire intermediate support mechanism. Accordingly, when the rectangular frame is associated with the corona charger for placement of a corona wire operatively therein and the tension control mechanism is activated, tension increase in the corona wire induced by insertion of the corona wire in the corona charger is controlled to balance wire tension in order to prevent corona wire damage or breakage. Thereafter, the long side members of the rectangular frame are separated from the short side members to enable removal of excess portions of the rectangular frame and the wire supporting mechanism.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
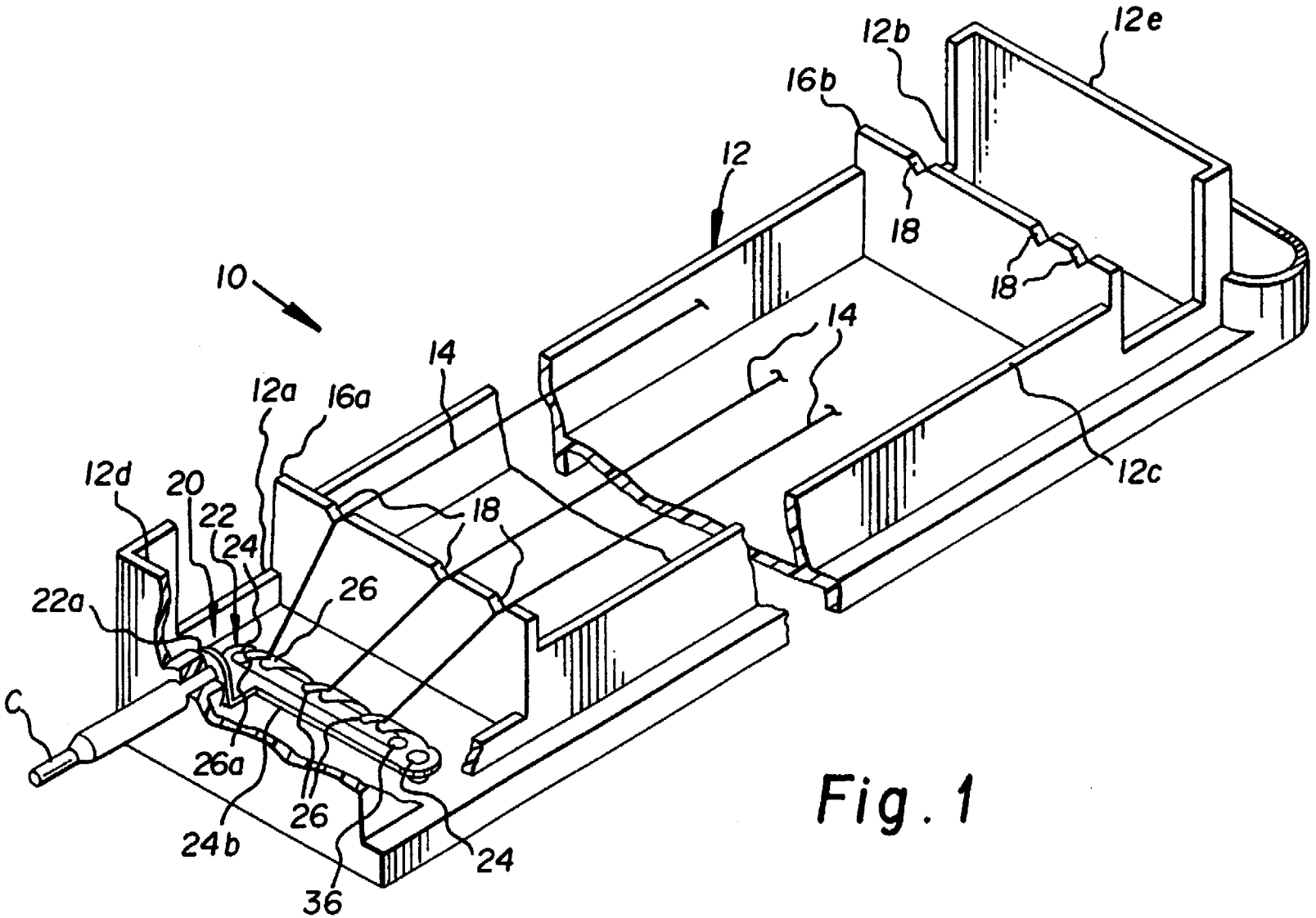
FIG. 1 is a view, in perspective, of a typical corona charger, with portions removed or broken away to facilitate viewing.
Figure 2:
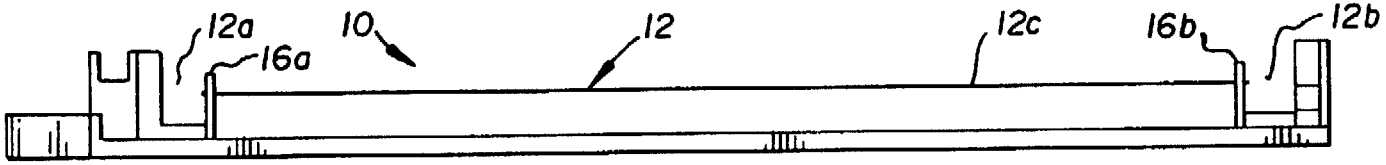
FIG. 2 is a side elevational view of the corona charger of FIG. 1.
Figure 3:
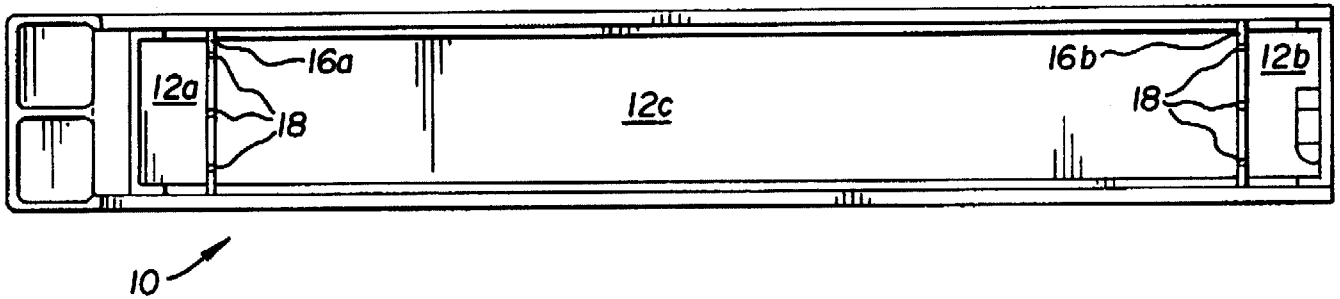
FIG. 3 is a top plan view of the corona charger of FIG. 1.

Referring now to the accompanying drawings, FIGS. 1–3 show a typical corona charger, designated generally by the numeral 10. The corona charger 10 is utilized, for example, for the general purpose of uniformly charging a dielectric member surface in any well known electrostatographic reproduction apparatus or the like, although other suitable uses for the corona charger are contemplated. The corona charger 10 includes a housing shell 12 having a first end portion 12*a* and a second end portion 12*b* interconnected by an elongated central portion 12*c*. The housing shell 12 is formed, for example, from an insulative resin material molded in the desired shape as shown. At least one corona wire is supported to span the length of the central portion 12*c* of the housing shell. There may, of course, be multiple corona wires, or a single wire threaded back-and-forth to make multiple passes over the length of the central portion 12*c*.

The central portion 12*c* of the corona charger housing shell 12 is bounded at its ends by bridge walls 16*a* and 16*b*. The bridge walls 16*a*, 16*b* may be integrally formed with the housing shell 12, or may be separate structures connected to the housing shell in any well known manner. A plurality of notches 18 are respectively provided in the walls 16*a*, 16*b*, at preselected locations, for supporting and positioning the corona wire 14, whereby the surface to be charged can be brought into accurate spaced association with the corona wires. The notches 18 may be V-shaped or of a substantially rectangular configuration as desired.

A mechanism 20 is provided in the first end portion 12*a* of the housing shell 12 for anchoring one respective end of the corona wire 14 in the corona charger, and for electrically coupling a suitable electrical high voltage potential source to the corona wire. The mechanism 20 includes an anchor assembly 22 formed of any suitable conductive material. The anchor assembly 22 has a body connected by suitable fasteners 24 to the housing shell 12. The body has a plurality of tabs 26 extending upwardly at an acute angle from a longitudinal edge of the body. The tabs 26 respectively define slots 26*a* at the ends remote from the body. The slots 26*a* are adapted to respectively receive runs of the corona wire 14. The corona wire 14 may be directly connected to the tabs 26, or the tabs may serve to capture the corona wire in the manner described below.

Additionally, the body of the anchor assembly 22 has a tab 22*a* extending substantially at a right angle away from a longitudinal edge of the body. The tab 22*a* is connected to an electrical conductor C supported so as to extend through an end wall 12*d* of the housing shell 12. The conductor C is adapted to be coupled to a high voltage potential source (not shown), whereby the electrical potential of the source is applied to the corona wire 14 through the electrically conductive path described from the conductor C, to the body of the anchor assembly 22, including the tabs 26, and then to the corona wire.

Figure 4:
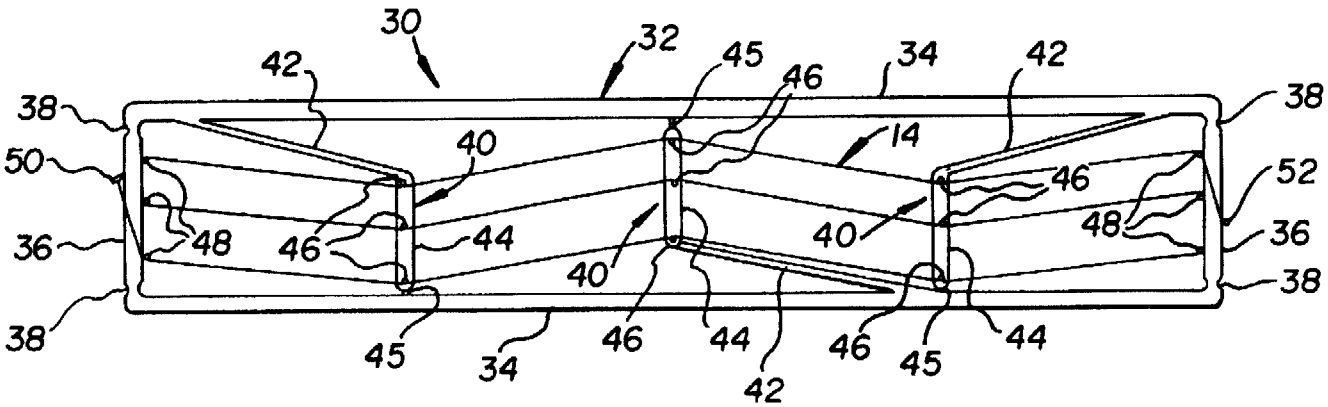
FIG. 4 is a top plan view of the corona wire handling device, according 16 this invention, for facilitating replacement of the corona wires for the corona charger of FIG. 1.

In order to facilitate handling of the corona wire 14 for replacement of the wire in the corona charger 10, or initial assembly of the corona charger, a device designated generally by the numeral 30 is provided according to this invention. The corona wire handling device 30, as best shown in FIG. 4, includes a frame 32 formed for example from a single piece of suitable plastic, such as for example, polystyrene. The frame 32, which is preferably injection molded, is substantially rectangular so as to include opposing parallel, equal length long side members 34, and opposing parallel, equal length short side members 36 respectively connected to the long side members. The portions of the short side members 36, designated by the numerals 38, representing the areas of connection of the short side members 36 to the long side members 34, are substantially thinner, than the short side members themselves. This enables the short side members 36 to be readily selectively separable from the long side members 34 for the purpose more fully described below.

The frame 32 also includes at least one member for supporting the intermediate portion of a corona wire 14 on the frame. The corona wire intermediate supporting member, designated generally by the numeral 40, is substantially J-shaped. Each of the members 40 has a first leg portion 42 and an integral second leg portion 44. The first leg portion 42, which is relatively flexible in the direction perpendicular to the longitudinal axis of the leg portion, is connected to one of the long side members 34 and extends at an angle therefrom. The second leg portion 44, which is relatively rigid, is connected to the opposite long side member and extends at a substantial right angle thereto. The connection of the first leg portion 42 to the long side member is substantially at the full size of the first leg portion, while the area 45 of, connection of the second leg portion to the respective long side member is substantially thinner than such side member so that the member 40 is readily selectively separable from the long side member for the purpose more fully described below. As shown in the preferred embodiment depicted in FIG. 4, there are a plurality of members 40 which are alternately connected to opposed long side members.

Figure 5:
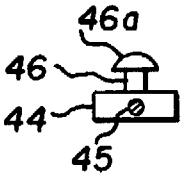
FIG. 5 is side elevational view, on an enlarged scale, of a wire guide post for the corona wire handling device of FIG. 5.

The second leg portion members 44 of each of the J-shaped members have a plurality of guide posts 46 extending respectively therefrom. The guide posts 46 serve to redirect a corona wire 14 supported thereon (as will be described in more detail below), and readily permit relative movement of the corona wire to the guide posts, in the direction along the longitudinal axis of the corona wire. As shown in FIG. 5, each of the guide posts include a cap 46*a*. The caps 46*a*, which may be formed for example by ultrasonically deforming the tops of the respective guide posts, serve to retain a corona wire in engagement with the posts. The caps 46*a* on the guide posts 46, which serve to capture the wire, can be replaced by other functional mechanisms (e.g., notches, hooks or the like) suitable for holding the wires to prevent their escape but permitting relative movement therebetween. Similar guide posts 48, which may also be capped, extend from the short side members 36. Further, the opposing short side members 36 also respectively include a first stanchion 50 and a second stanchion 52 attached thereto.

With the above described construction for the corona wire handling device 30 according to this invention, a single typical corona wire 14 is strung under tension in zigzag fashion from a first stanchion 50 to the second (final) stanchion 52, past the guide posts 46 and 48, under virtually no, or only a slight degree of, tension. The corona wire 14 may be stung manually, or by means of a suitable robotics device (not shown). The use of robotics in stringing the corona wire offers distinct advantages. That is, by substantially eliminating manual intervention (the wires are untouched by human hands), contamination of the wires is substantially reduced, as would also wire breakage, especially for very thin wires (e.g., on the order of 0.3 mils or less). Robotic stringing is especially useful for expensive noble metal corona wires or noble metal plated corona wires (such as gold-plated or platinum alloy wires) because such wires are generally very soft and easily scratched or damaged. It can be appreciated that after the corona wires have been strung on the frames 32 of the handling devices 30, the handling devices are readily packaged by any suitable robotic device for shipping. This will substantially reduce the danger of damage during packaging. When these packages are later opened, the ability to handle each corona wire handling device 30, at all times, by the frame 32 substantially reduces the risk of corona wire contamination and/or breakage. These advantages, as well as the additional advantage of more rapid installation of corona wires results in considerable cost savings.

It is evident that the number and location of the guide posts 46 and 48 is dependent upon the geometrical configuration of the corona charger with which the frame 32 of the corona wire handling device 30 is to be associated. That is, the frame 32 may be readily modified to fit any desired corona charger shell design, including single or multi-wire chargers. For example, if more than one corona wire is to be used for corona chargers having one or any number of parallel longitudinal wires, there may be more than just the two stanchions 50, 52. Rather than using a single length of wire in a frame according to this invention, more than one wire can be used, each wire anchored to appropriate stanchions (which may be common stanchions).

Figure 6:
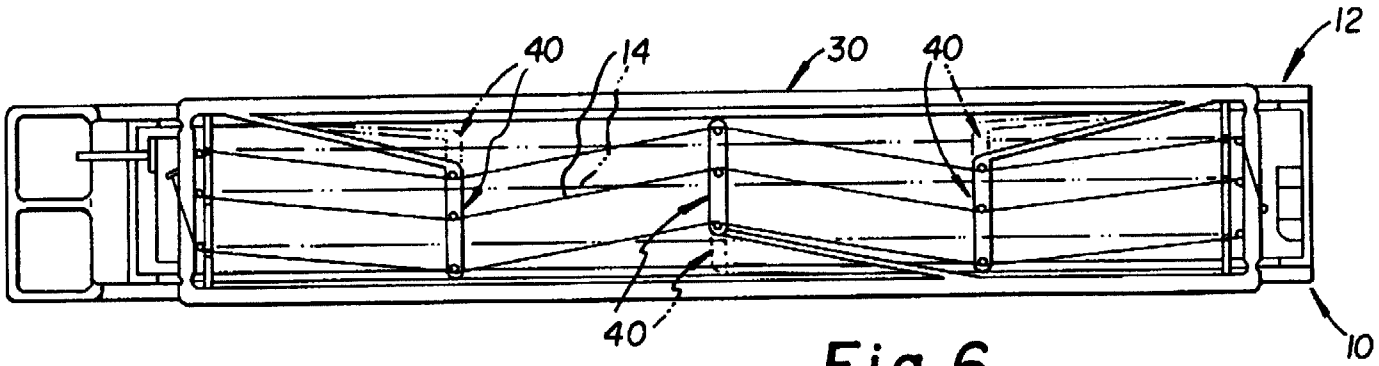
FIG. 6 is a top plan view of a corona charger and the corona wire handling device, according to this invention, in association for replacement of the corona wires.

As noted above, the frame 32 of the corona wire handling device 30 has particular connecting portions 38 and 45 which are much thinner than the remainder of the frame. These necked down portions enable the frame to be easily severed, such as by being cut with a tool or snapped apart manually, to separate the various members of the frame. When the corona wire handling device 30 is employed to insert a corona wire 14 into the housing shell 12 of the corona charger 10, first the areas 45 are severed. The short side members 36 of the frame 32 are then aligned with the ends portions 12*a* and 12*b* of the charger housing shell 12 as shown in solid lines in FIG. 6. The short side members are then forced into the shell housing end portions 12*a*, 12*b* to initiate application of a desired tension to the corona wire by bending the flexible frame 32 over bridge walls 16*a*, 16*b* of the housing of the corona charger 10.

Prior to applying the bending stress to the frame 32 of the corona wire handling device 30, the rims of the corona wire 14 are inserted into the notches 18 of the bridge walls 16*a*, 16*b*. The short side members 36 are retained near the floor of each of the housing portions 12*a*, 12*b*, located outboard of the walls 16*a*, 16*b*, such as by the anchor assembly 22 (see FIG. 1). During the bending of the frame 32 and attachment of the short side members 36 to the anchor assembly, the corona wire 14 tends to straighten out from its initial zigzag configuration between the bridge walls 16*a*, 16*b*. As can be seen in the phantom lines of FIG. 6, the straightening of the corona wire is accompanied by opening up the gaps produced by the previous separation of the legs 44 of the members 40 from the long side members 34 by the severing of portions 45. The reactive action of the members 40 serve to balance any tension build-up on the corona wire 14 during the process of insertion into the corona charger 10. That is, an appropriate degree of tension is maintained on the corona wire to enable proper insertion of the corona wire without breakage due to excessive tension.

It may be noted that, in the preferred embodiment shown in the accompanying drawings, the guide posts 48 attached to the short side members 36 are not equidistantly spaced and are located in a way so as not to line up with the notches 18. This forces the runs of the corona wire 14 to bind at the edges of the notches 18 after the short side members 36 have been gripped in the anchor assembly 22. As such, the bind in the wire serves to help retard wire vibration during operation of the corona charger. Of course, according to this invention, equidistantly spaced guide posts, or guide posts aligned with the notches 18, can be used on the short side members 36.

Figure 7:
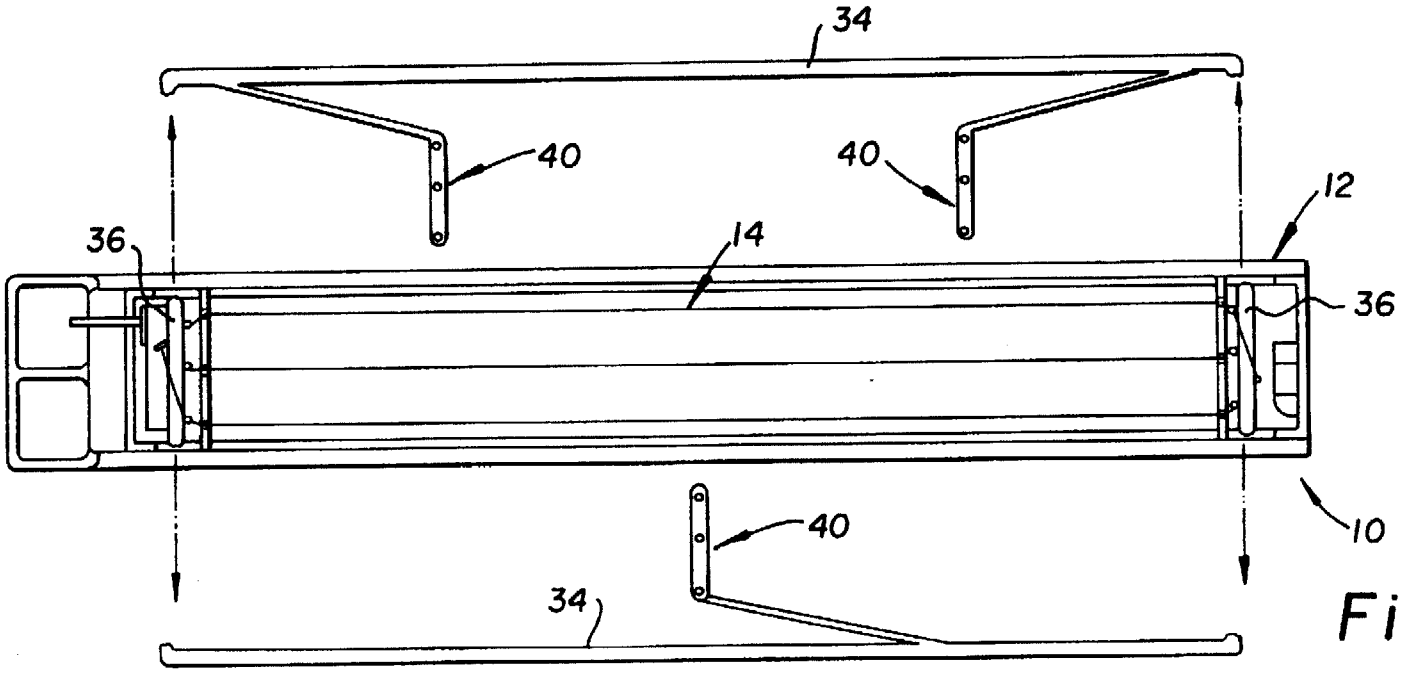
FIG. 7 is a top plan view of a corona charger and the corona wire handling device, according to this invention, after replacement of the corona wires and with excess portions of the handling device removed.

For the last step in the installation of the corona wire 14, the thinned portions 38 connecting the short side members 36 with the long side members 34 are severed. After the portions 38 have been severed, the two long side members 34 of frame 32, which are then no longer connected to the short side members 36, are considered excess and can be removed and discarded (see FIG. 7). The J-shaped members 40, connected to the long side members 34, are of course also discarded with the long side members.

The invention has been described in detail with particular reference to preferred embodiment thereof, but it will be understood that variations and modifications can be effected within the spirit and scope of the invention as set forth in the claims.

What is claimed is:

1. A device for handling a corona charger wire in order to facilitate the placement of a corona wire in operative association within a corona charger, said corona wire handling device comprising:

means for supporting the ends of at least one corona wire;

means, associated with said corona wire end supporting means, for supporting an intermediate portion of said at least one corona wire; and means for controlling tension on said corona wire, supported on said corona wire end supporting means, induced by said corona wire intermediate portion support means, whereby when said corona wire end supporting means is associated with a corona charger for insertion of a corona wire operatively therein and said tension controlling means is activated, tension increase in said corona wire, which would be induced by insertion of said corona wire in said corona charger, is controlled to balance corona wire tension in order to substantially prevent corona wire damage or breakage.

2. The corona wire handling device of claim 1 wherein said corona wire end supporting means includes a substantially rectangular frame, said frame having opposed long side members and opposed short side members.

3. The corona wire handling device of claim 2 further including means for enabling ready separation of said long side members of said rectangular frame from said short side members to enable removal of excess portions of said rectangular frame and said corona wire intermediate portion supporting means after said corona wire is inserted in said corona charger.

4. The corona wire handling device of claim 3 wherein said means for enabling separation includes portions of said rectangular frame, located at the respective junctions of said long side members and said short side members of said frame, said portions being substantially thinner than said frame members.

5. The corona wire handling device of claim 3 wherein said means for supporting the intermediate portion of said corona wire includes at least one member having an elongated flexible portion, connected at one end to one of said side members of said frame, and an elongated substantially rigid portion, connected at one end to said flexible portion and at the other end to an opposed side member of said frame.

6. The corona wire handling device of claim 3 wherein said means for supporting the intermediate portion of said corona wire includes a plurality of members, said members respectively having an elongated flexible portion, connected at one end to one of said side members of said frame, and an elongated substantially rigid portion, connected at one end to said flexible portion and at the other end to an opposed side member of said frame.

7. The corona wire handling device of claim 6 wherein said plurality of corona wire intermediate portion supporting members are generally J-shaped.

8. The corona wire handling device of claim 6 wherein said elongated rigid portions of said corona wire intermediate portion supporting members respectively include at least one upstanding guide post for said supported corona wire.

9. The corona wire handling device of claim 8 wherein said upstanding guide posts for said supported corona wire have means associated therewith for retaining said corona wire in association with said guide posts.

10. The corona wire handling device of claim 9 wherein said retaining means of said upstanding guide include caps to retain said corona wire in association with said guide posts.

11. The corona wire handling device of claim 8 wherein said means for supporting the ends of said corona wire further includes stanchions respectively connected to opposed side members of said frame, said stanchions serving to retain the ends of a corona wire.

12. The corona wire handling device of claim 6 wherein said elongated rigid portions of said corona wire intermediate support members respectively include at least one upstanding guide post for said supported corona wire, and said means for supporting the ends of said corona wire further includes stanchions respectively connected to opposed side members of said frame, said stanchions serving to retain the ends of a corona wire, whereby a corona wire may strung from one stanchion, about said guide posts, to another stanchion.

13. The corona wire handling device of claim 12 wherein adjacent corona wire supporting members are oriented such that the respective connections to said opposed side members of said rectangular frame are reversed.

14. The corona wire handling device of claim 13 wherein said guide posts on said respective corona wire supporting members are located such that a strung corona wire assumes a zigzag configuration.

15. The corona wire handling device of claim 6 wherein said means for controlling tension on said corona wire induced by said corona wire intermediate support members includes portions of said rectangular frame, located at the respective junctions of said side members of said frame and said elongated substantially rigid portions, said portions being substantially thinner than said side members and said rigid portions.

16. A device for handling a corona charger wire in order to facilitate the placement of a corona wire in operative association within a corona charger, said corona wire handling device comprising:

a substantially rectangular frame, said frame having opposed long side members and opposed short side members;

at least one member, for supporting the intermediate portion of at least one corona wire on said frame, said member having an elongated flexible portion, connected at one end to one of said side members of said frame, and an elongated substantially rigid portion, connected at one end to said flexible portion and at the other end to an opposed side member of said frame;

means for controlling tension on said corona wire, supported on said frame, induced by said corona wire intermediate portion support member, whereby when said rectangular frame is associated with a corona charger for insertion of a corona wire operatively therein and said tension controlling means is activated, tension increase in said corona wire, which would be induced by insertion of said corona wire in said corona charger, is controlled to balance corona wire tension in order to substantially prevent corona wire damage or breakage; and means for enabling ready separation of said long side members of said rectangular frame from said short side members to enable removal of excess portions of said rectangular frame and said corona wire intermediate portion support member after said corona wire is inserted in said corona charger.

17. The corona wire handling device of claim 16 wherein said means for enabling separation includes portions of said rectangular frame, located at the respective junctions of said long side members and said short side members of said frame, said portions being substantially thinner than said frame members.

18. The corona wire handling device of claim 16 wherein the support for the intermediate portion of said corona wire includes a plurality of members, said members respectively having an elongated flexible portion, connected at one end to one of said side members of said frame, and an elongated substantially rigid portion, connected at one end to said flexible portion and at the other end to an opposed side member of said frame, adjacent corona wire supporting members being oriented such that the respective connections to said opposed side members of said rectangular frame are reversed.

19. The corona wire handling device of claim 18 wherein said elongated rigid portions of said corona wire intermediate support members respectively include at least one upstanding guide post for said supported corona wire, and wherein stanchions are respectively connected to opposed side members of said frame, said stanchions serving to retain the ends of a corona wire, whereby a corona wire may strung from one stanchion, about said guide posts, to another stanchion.

20. The corona wire handling device of claim 18 wherein said means for controlling tension on said corona wire induced by said intermediate corona wire support members includes portions of said rectangular frame, located at the respective junctions of said side members of said frame and said elongated substantially rigid portions of said intermediate support members, said portions being substantially thinner than said side members and said rigid portions.

* * * * *